United States Patent [19]

Koch et al.

[11] 4,421,623

[45] Dec. 20, 1983

[54] APPARATUS FOR GUIDING MATERIAL IN STRIP FORM

[75] Inventors: Friedbert Koch, Witten; Bernhard Schweinsberg, Bochum, both of Fed. Rep. of Germany

[73] Assignee: C. Otto & Comp. G.m.b.H., Bochum, Fed. Rep. of Germany

[21] Appl. No.: 444,049

[22] Filed: Nov. 22, 1982

[30] Foreign Application Priority Data

Nov. 26, 1981 [DE] Fed. Rep. of Germany ..... 3146850

[51] Int. Cl.[3] ..... C25D 17/00

[52] U.S. Cl. ..... 204/206

[58] Field of Search ..... 204/206

[56] References Cited

U.S. PATENT DOCUMENTS 1,115,671 11/1914 Herrmann ..... 204/206

2,378,002 6/1945 Drummond ..... 204/206

*Primary Examiner*—T. M. Tufariello

*Attorney, Agent, or Firm*—Thomas H. Murray; Clifford A. Poff

[57] ABSTRACT

An apparatus is disclosed which guides material in strip form horizontally between vertically-disposed electrodes in an electrolytic coating, pickling or degreasing process. The electrodes are attached to two vertically-disposed insulated frames positioned on either side of the strip. At both ends of the frames, relative to the direction of movement, are pairs of rollers through which the strip passes before and after treatment. The frames are pressed together by means of two pairs of scissor arms which are secured to the frame at one end and at the other end are compressed by tensioning means. The apparatus is suspended by support arms, the bottom ends of which are pivotally connected to the pivot pins of the scissor arms with the top ends movably secured to the tank.

7 Claims, 3 Drawing Figures

APPARATUS FOR GUIDING MATERIAL IN STRIP FORM

BACKGROUND OF THE INVENTION

This invention relates generally to guiding material in strip form between two vertically-disposed electrodes incident to an electrolytic coating, pickling or degreasing process.

Heretofore the electrodes have been positioned in a stationary manner about the strip. As a result of the rigid construction of previous guide means, variations in the tension on the strip cause the strip to occasionally sag or twist, resulting in damage to the electrodes. In prior art embodiments, the gap between the electrodes and the strip is relatively large to prevent damage to the electrodes in situations where the strip sags or twist or would otherwise come into contact with the electrodes. West German patent publication No. 2,937,992 discloses an apparatus for the continuous electrolytic descaling of steel wire. In that apparatus, the steel wire moves between fixed guide rolls arranged in a trough between and after two or more tubular electrodes or plate electrodes, which electrodes are separated by spacers. The known apparatus cannot provide for reliable and efficient guidance of material in strip form.

SUMMARY OF THE INVENTION

An object of the invention is to provide an apparatus for maintaining a constant minimum gap between the electrodes and a moving strip despite considerable variations in tension and manner of extension of the strip. By maintaining a constant minimum distance between the electrodes and the strip, the invention permits a substantial reduction in the voltage required to accomplish the intended electrolytic function in addition to preventing damage to the electrodes.

The present invention provides an apparatus for guiding a strip between equally-spaced electrodes through a tank in which the electrodes are supported. The apparatus consists of frames made of electrically-insulated material which support the electrodes on opposite sides of the strip. At opposite ends of the electrodes are insulated pairs of rollers supported by the frames through which the strip passes during treatment. The frames are held together by pivot means which position the electrodes in a generally parallel relation to the movement of the strip between the frames. Tensioning means apply pressure to the frames, thereby urging the rollers into contact with the strip. Support arms interconnect the tank to the pivot means permitting movement of the frames without disturbing the relative position of the electrodes.

One embodiment of the apparatus provides for the mounting of the electrodes upon vertically-spaced insulated frames positioned on opposite sides of the strip and extending generally parallel to the direction of movement of the strip of material. Pairs of rollers, through the strip undergoing treatment passes, are attached at opposite ends of the frames. The frames and the roller pairs are compressed by means of pairs of scissor arms having arm ends secured to the frames and other arm ends pressed together by tensioning means. Support arms are pivotally connected, at one end, to pivot pins for the scissor arms and at the other end the support arms are pivotally supported, e.g., by the tank in which the electrolytic process is conducted.

The apparatus of the invention enables the electrodes to be placed closer to the strip than in the known apparatus. Should variations in strip tension occur, the strip remains in the same position relative to the electrodes due principally to the mounting of the electrodes on movable frames. Support arms are pivotally attached to the frames so that the space between the frames changes in response to the variations in tension. This positioning of the electrodes, in addition to an evenness of movement, is in response to the passage of the strip between the pairs of rollers, which are also held together by the scissor arms. This allows the electrodes to be positioned in uniformly small and constant increments above and below the strip. As a result of this construction, increments as small as a few millimeters can be successfully maintained.

The pairs of rollers are mounted in an electrically-insulated manner and may themselves be constructed of an electrically-insulated material. Alternatively pairs of rollers constructed of an electrically-insulative material, such as metal, may be used in conjunction with electrically-insulated mountings. The pairs of rollers, consisting of the conductive material and secured on an insulated mounting may be supplied with electrical current, thus reducing electrical losses during the treatment process. It has further been found to be more advantageous to employ double pairs of rollers at each end of the frames. The double pairs of rollers improve the horizontal stability of the strip as it passes between the electrodes.

Practical tests have shown that the apparatus of the present invention enables the electrodes to be moved to within a few millimeters of the strip. As a result of the corresponding reduction of the electrolytic voltage required to achieve the desired result, the efficiency of the process is substantially improved.

The above and other objects and features of the invention will become apparent from the following detailed description of a preferred embodiment taken in connection with the accompanying drawings which form a part of this specification, and in which.

Figure 1:
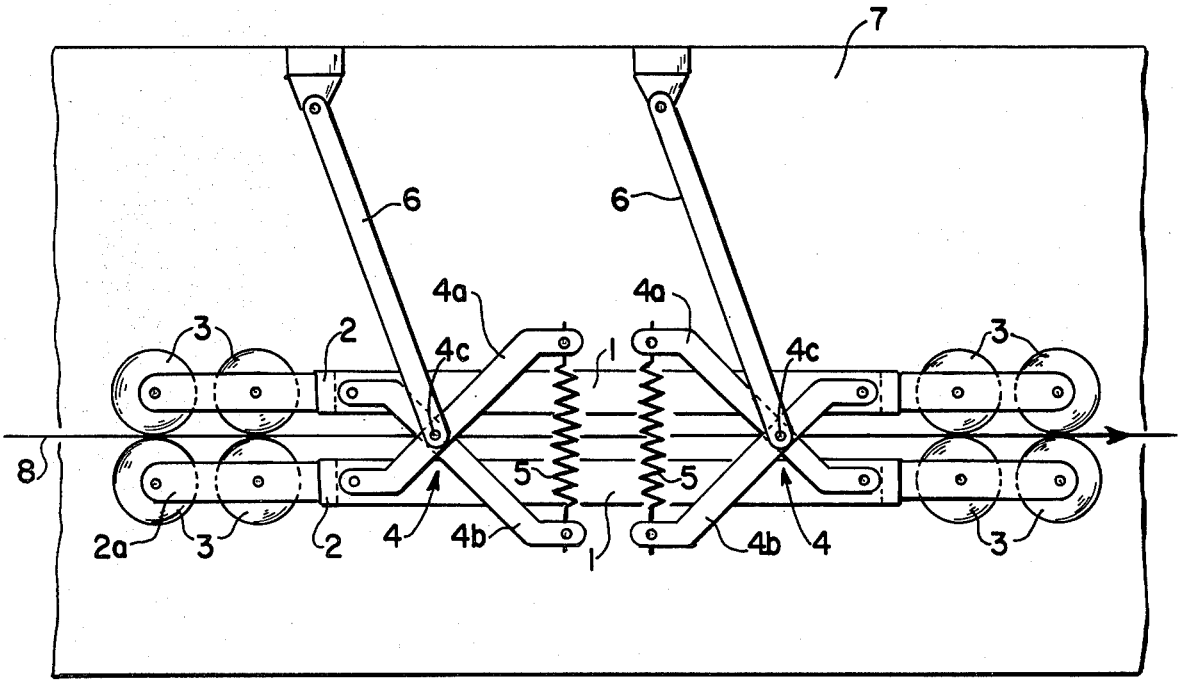
FIG. 1 is a diagrammatic side view of the apparatus described herein.
Figure 2:
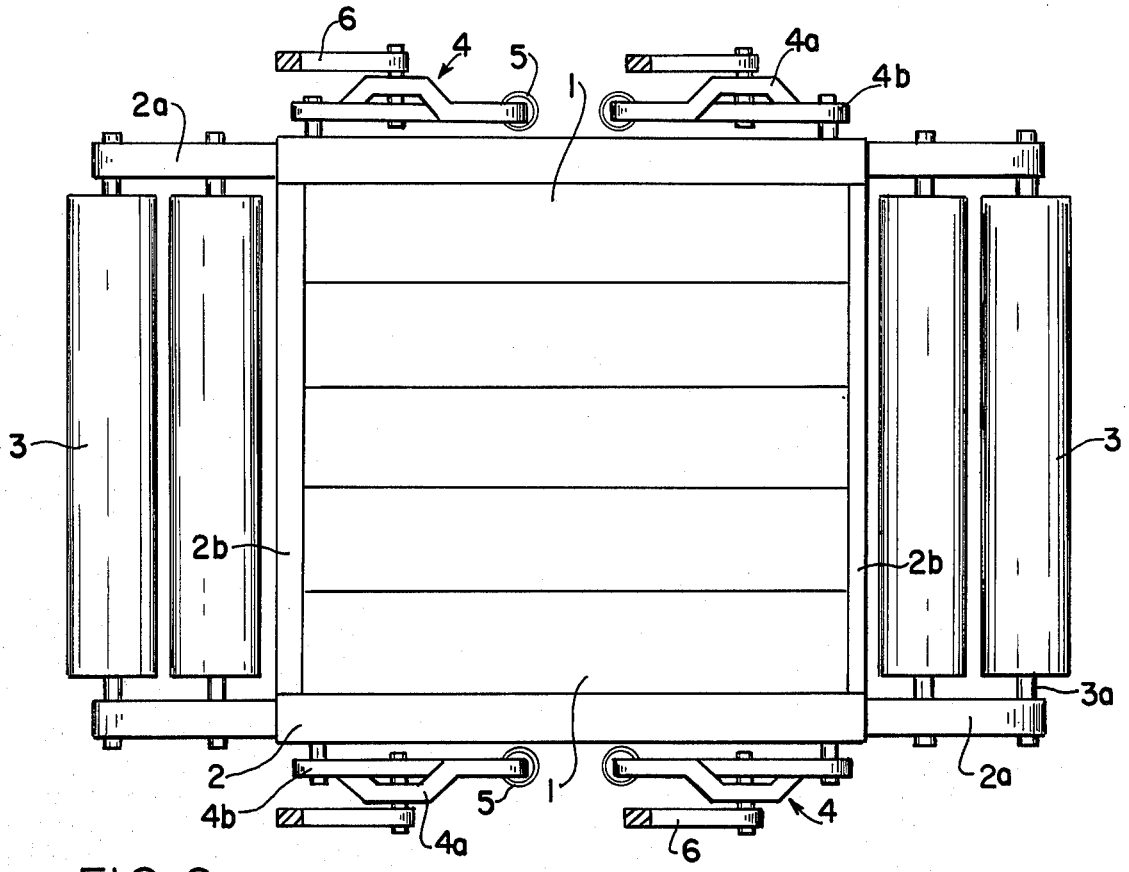
FIG. 2 is a diagrammatic plan view of the apparatus described herein.

Referring now more particularly to FIGS. 1 and 2 of the drawings, the apparatus of the present invention provides for guiding strip 8 through a tank 7. The apparatus is suspended by support arms 6 whose top ends are pivotally connected to the tank walls to enable motion of the apparatus in the direction of movement of the strip 8. Electrodes 1 are mounted on each of vertically-disposed, electrically-insulated frames 2 which are positioned parallel to the direction of strip movement which is indicated by an arrow in FIG. 1. The apparatus includes a pair of frames which are positioned at opposite sides of the strip 8. Two pairs of rollers 3 are supported at opposite ends of each frame 2 by frame extensions 2*a*. The lateral side members of each frame are interconnected by cross members 2*b* (FIG. 2). The pairs of rollers are positioned by the frames to operate in rolling contact with the strip 8. The strip 8, shown in FIG. 1. passes between a first group of upper and lower pairs of rollers 3 which are at the front in the direction of movement. The strip 8 then passes through a gap between the electrodes 1 and leaves the apparatus by way of a second group of upper and lower pairs of rollers 3. The rollers 3 are made of electrical-insulated material and supported by the frames 2. The frames 2 carrying the electrodes are held together and kept aligned by four scissor arm assemblies 4 positioned, in the manner visible in FIG. 2, in pairs on both sides at opposite ends of the frames 2. The scissor arm assemblies each includes two bent arms 4*a* and 4*b*. An end of each arm is attached by a pivot to one of the frames and the other ends are urged together by springs 5 or other tensioning means about a pivot pin 4*c*. The bottom ends of the support arms 6 are pivotally secured to the pivot pins 4*c* of the scissor arm assemblies 4. The described construction permits the apparatus to travel in the direction of and in relation to all strip movements. This construction results in a substantially constant gap between the electrodes even when extreme variations in strip tension and velocity occur.

Figure 3:
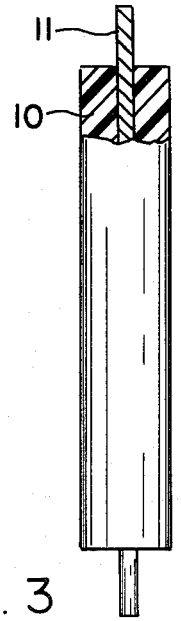
FIG. 3 is a diagrammatic plan view, partly in section, of the roller and the mounting by which the roller is supported.

An alternative construction of the pairs of rollers is shown in FIG. 3. In this embodiment, the ro11er body 10 is comprised of an electrical conductor such as metal, and support shafts 11 on which the roller is mounted are comprised of an electrical insulator. The shafts may be made of metal and supported through electrically-insulated sleeves by the frames. In this manner, electric current can be passed through the roller body 10, thereby reducing electrical losses along the treatment process.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. Apparatus for guiding a strip between equally-spaced electrodes, a tank in which said electrodes are supported, the combination therewith of said apparatus which comprises:

frames made of electrically-insulated material for supporting said electrodes at opposite sides of the strip, pairs of rollers supported by said frames at opposite ends of said electrodes for passing the strip therebetween, pivot means for holding together said frames and thereby positioning said electrodes in a generally parallel relation to movement of the strip therebetween, tensioning means for applying pressure to said frames to urge said rollers into contact with the strip, and support arms interconnecting said tank and said pivot means to permit movement of the frames without disturbing the relative position of said electrodes.

2. The apparatus of claim 1 wherein said pivot means includes pairs of arms, and pivots for connecting said pairs of arms to said support arms.

3. The apparatus of claim 1 wherein said pivot means includes scissor arms, one end of said scissor arms being attached to said frames, tensioning means attached to the other end of said scissor arms for pressing them together, and pivot pins interconnecting said scissor arms and supported by said support arms.

4. The apparatus of claim 1 wherein said pairs of rollers are made of an electrical-insulated material.

5. The apparatus of claim 1 wherein said pairs of rollers each comprising a body made of an electrical-conductive material, and shafts made of an electrical-insulated material for supporting the rollers on said frame.

6. The apparatus of claim 1 wherein said pairs of rollers comprise two pairs of rollers positioned at opposite ends of said frames.

7. The apparatus of claim 1 wherein the tensioning means comprise springs.

* * * * *